United States Patent [19]

Dalla Lana

[11] Patent Number: 4,893,417

[45] Date of Patent: Jan. 16, 1990

[54] INNER SHOE FOR SHELL-TYPE SKI BOOT

[75] Inventor: Antonio Dalla Lana, Montebelluna, Italy

[73] Assignee: Lange International S.A., Switzerland

[21] Appl. No.: 242,783

[22] Filed: Sep. 9, 1988

[30] Foreign Application Priority Data

Sep. 15, 1987 [CH] Switzerland ..... 3552/87

[51] Int. Cl.[4] ..... A43B 19/00; A43B 5/04

[52] U.S. Cl. ..... 36/10; 36/88; 36/119

[58] Field of Search ..... 36/10, 9, 117–121, 36/71, 88, 93

[56] References Cited

U.S. PATENT DOCUMENTS 4,268,931 5/1981 Salomon ..... 36/10 X 4,499,675 2/1985 Perotto ..... 36/119

4,702,022 10/1987 Porcher ..... 36/119

4,723,364 2/1988 Marxer ..... 36/10

FOREIGN PATENT DOCUMENTS 3429284 2/1986 Fed. Rep. of Germany ..... 36/119

*Primary Examiner*—James Kee Chi

*Attorney, Agent, or Firm*—Kane, Dalsimer, Sullivan, Kurucz, Levy, Eisele and Richard

[57] ABSTRACT

The inner shoe in the form of a boot has, in the region of the instep, a deformable narrow zone of lesser resistance (2) which extends across the front part of the upper and on either side of the instep towards the end of the foot and defines a tongue-shaped zone (4). The upper (3) is thus able to flex forwards, while the tongue-shaped zone (4) is able to press against the instep without being retained by the upper.

4 Claims, 2 Drawing Sheets

INNER SHOE FOR SHELL-TYPE SKI BOOT

FIELD OF THE INVENTION

The present invention relates to an inner shoe for a ski boot with a rigid or semi-rigid shell, in the form of a boot, at least in its front part, and having, in the region of the instep, a deformable narrow zone with less resistance than the remainder of the boot.

PRIOR ART

Modern ski boots which have a rigid shell, with rear entry and internal clamping of the foot, or a semirigid shell, with external clamping of the foot, comprise an inner shoe, often called a "slipper", intended to ensure that the foot is comfortable inside the boot. This inner shoe is generally made of a flexible material padded internally and often with reinforced parts, in particular around the upper and above the instep, i.e. the areas supporting the pressure of the clamping members. An inner shoe commonly used has a rigid tongue fixed at its bottom end in the vicinity of the end of the foot and extending over the instep and the front part of the upper. The clamping means must not, however, only exert a pressure on this tongue, but also on the edges of the groove in the inner shoe, covering the tongue. Clamping gives rise to deformations, folds and localized pressure zones which may be painful. Furthermore, such a tongue offers a resistance which is difficult to control when the ankle is flexed and which even has the tendancy to apply greater pressure to the instep during flexion, while the latter tends to be raised during flexion.

Inner shoes in the form of a boot, i.e. without a front tongue, are also known. These inner shoes also have a great resistance to flexion and to deformation in general and, when clamped by the clamping members, give rise to folds creating localized pressure zones which may be painful.

It has been proposed to remedy these drawbacks by providing a boot-shaped inner shoe with a wide groove on the instep and a lateral slit extending from this groove towards the end of the foot (EP-A-227 130). Such an inner shoe overcomes, in fact, certain drawbacks of inner shoes of the prior art, but the distribution of pressure over the instep is not ideal because of the groove and asymmetry of the upper. Used in a ski-boot with internal clamping and a device for distributing the pressure over the instep, such an inner shoe still has areas of localized pressure at the edges of the groove.

On the other hand, a boot-shaped inner shoe is known, which has two substantially parallel slits extending on either side of the instep between the end of the foot and the middle of the front part of the upper so as to allow the part of the inner shoe extending over the instep to be raised in order to follow raising of this part of the foot during flexion forwards (DE-A-34 29 284). These slits may be closed by an extendable part, for example a bellows. Since, however, the inner shoe possesses a certain rigidity, the desired effect of this measure is illusory because bending of the upper forwards causes the instep area to retract towards the inside of the shoe, the part covering the instep being fixed at its ends between the upper and the end of the foot. For the same reason, when the foot is clamped, for example by means of a cable acting on a pressure distribution device located above the instep, the inner shoe offers resistance to the clamping action since the latter tends to pull the upper forwards, while this upper is retained by the upper of the shell. This action prevents even distribution of the clamping pressure over the instep and the foot. However, in order to ensure both that the foot is properly held, i.e. a relatively strong clamping action, and a degree of comfort, the clamping pressure must be distributed as uniformly as possible over the foot.

In all the known inner shoes which offer considerable resistance to deformation when the foot is clamped, these deformations tend to become permanent when they are maintained for a certain period of time, as is generally the case. In particular, folds form on the upper of the inner shoe, folds which create painful localized pressure zones.

The object of the present invention is to overcome the abovementioned drawbacks and create an inner shoe which is capable of changing shape elastically when acted upon by clamping means, without forming folds or the like, and of uniformly transmitting the pressure of the clamping means, in particular the distribution plate, over the foot and instep.

SUMMARY OF THE INVENTION

The inner shoe according to the invention is characterized in that the said deformable narrow zone of lesser resistance extends across the front part of the upper and on either side of the instep towards the end of the foot, defining a tongue-shaped zone.

Therefore, without abandoning the advantageous boot shape, an inner shoe is obtained, with a flexible zone in the region of the instep, capable of adapting perfectly to the instep and transmitting uniformly the pressure of the clamping means, whether it be an internal plate distributing the pressure or the pressure of the shell itself subject to the action of external clamping means. The location of the deformable narrow zone of lesser resistance gives the upper of the inner shoe a certain freedom and allows it in particular to bend forwards without being retained by the instep region. Permanent deformations are eliminated and the overall flexibility of the inner shoe is improved owing to the lessening of resistance in the region of the instep and the heel.

BRIEF DESCRIPTION OF THE DRAWINGS

The accompanying drawing shows, by way of example, an embodiment of the invention.

DESCRIPTION OF THE PREFERRED EMBODIMENT(S)

Figure 1:
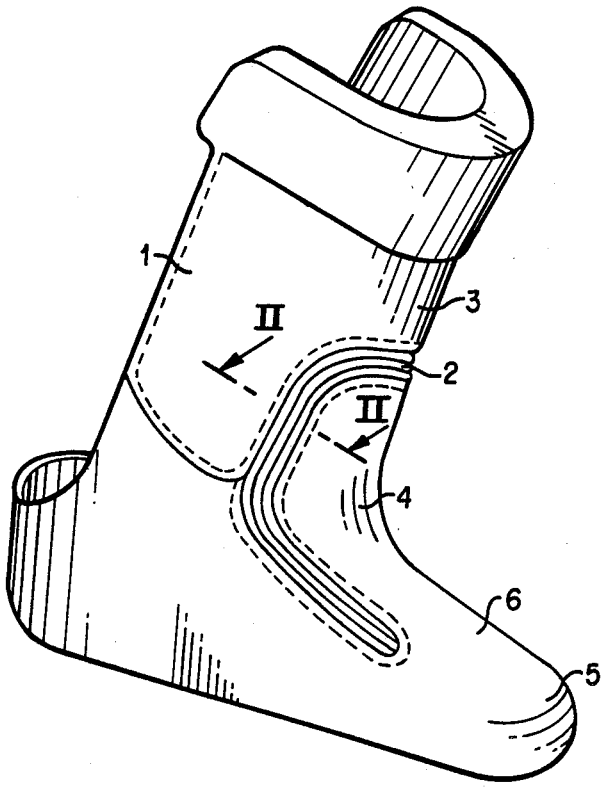
FIG. 1 is a perspective view of the inner shoe.

The inner shoe shown in FIG. 1 has the general shape of a boot open at the rear. The rear part is generally provided with a tongue (not shown). This inner shoe consists of a flexible casing provided with internal padding. It has an external reinforcement 1, made of synthetic material, around the upper. On its front part, the inner shoe has a deformable narrow zone of lesser resistance 2 extending across the front part of the upper 3 and on either side of the instep 4, towards the end of the foot 5, in such a way that it defines a tongue-shaped zone 4 forming an extension, towards the rear, of the foot region 6.

Figure 2:
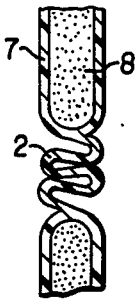
FIG. 2 is a detail, sectioned along II—II, of the deformable narrow zone of lesser resistance.
Figure 3:
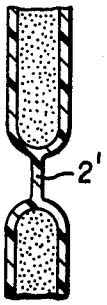
FIG. 3 is a variation of embodiment of FIG. 2.

The deformable zone 2 is preferably in the form of a bellows, as shown in FIG. 2. This bellows may be formed as a single piece with the plastic casing 7 forming the external and internal walls of the boot and containing synthetic foam 8. By way of a variation, according to FIG. 3, the part 2, indicated as 2' in the said FIG. 3, may simply consist of a flexible thin part of the wall of the boot.

It can be easily understood that the part 4 has a certain degree of freedom with respect to the remainder of the inner shoe. It is able to flex elastically about the point where it is joined to the front part 6. Consequently, the means for clamping the boot, for example a pressure distribution plate, will not encounter any significant resistance and their action will be transmitted immediately and efficiently to the foot. Since the zone 4 has a shape matching the instep, it transmits the clamping pressure in a particularly uniform manner. No localized pressure zones are therefore created.

Figure 4:
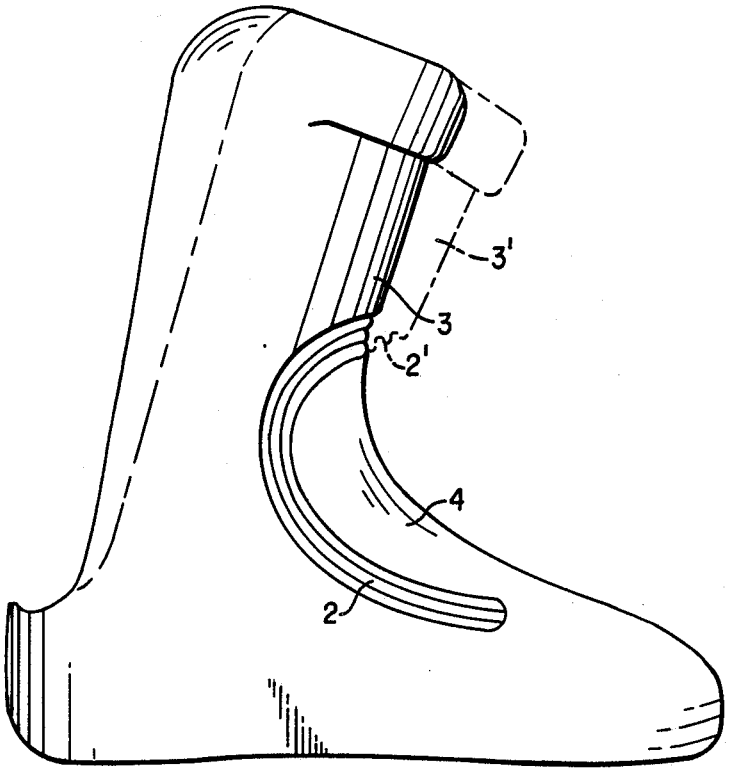
FIG. 4 shows, in schematic form, the movement of the upper when flexed forwards.

Furthermore, the deformable zone 2 improves the flexibility of the whole inner shoe. Flexing of the upper 3 forwards or backwards is facilitated in particular. FIG. 4 shows the upper 3 flexed forwards. The forwards flexed position of the upper 3+ is shown in dot-dash lines. It must be imagined that the region 4 is held between the foot and the shell, and the clamping means respectively. Without the deformable zone 2, the upper 3 would not be able to flex in practice.

The region 4 could simply be reinforced. This reinforcement could even make it possible to dispense with an auxiliary pressure distribution piece.

I claim:

1. An inner shoe for a ski-boot comprising a shell in the form of a boot with an upper region and a lower region separated by an instep region, a deformable narrow zone of lesser resistance extending horizontally across the front of the mid upper region with the ends of the deformable zone extending downward along the outer sides of the instep toward the end of the lower region of the boot, defining a tongue-shaped region, the deformable zone creating a flexible zone in the instep region.

2. Inner shoe as claimed in claim 1, wherein the deformable narrow zone is in the form of bellows.

3. The inner shoe of claim 1 wherein the shell is comprised of semi-rigid material.

4. The inner shoe of claim 1 wherein the shell is comprised of a rigid material.

* * * * *